United States Patent [19]

Rentowl

[11] Patent Number: 4,584,213

[45] Date of Patent: Apr. 22, 1986

[54] COMMEMORATIVE CARD

[76] Inventor: Patricia L. Rentowl, 58 Gratwicke Rd., Tilehurst, Reading RG3 4TT, Berkshire, England

[21] Appl. No.: 720,075

[22] Filed: Apr. 4, 1985

[30] Foreign Application Priority Data

Apr. 6, 1984 [GB] United Kingdom ..... 8408943

[51] Int. Cl.[4] ..... A47G 7/02

[52] U.S. Cl. ..... 428/23; 40/124.1; 47/41.12; 206/232; 206/423; 229/92.8

[58] Field of Search ..... 428/13, 23; 40/124.1; 47/41, 41.12; 206/232, 423; 229/92.8

[56] References Cited

U.S. PATENT DOCUMENTS 1,885,879 11/1932 Whittington ..... 428/23 X 2,217,454 10/1940 Pfeiffer ..... 428/23 X 4,418,497 12/1983 Mastriano ..... 428/7 X

*Primary Examiner*—Henry F. Epstein

*Attorney, Agent, or Firm*—Bruns and Wall

[57] ABSTRACT

A commemorative card is formed from water impervious or water resistant material and is provided with means for mounting at least one fresh or artificial flower thereon. Where the card is to carry a fresh flower or flowers, means for supplying moisture to the flower or flowers, such as a water-retentive hard foamed plastics material, may be provided to keep the flower or flowers fresh. The water retentive material may be mounted in a pocket or recess formed at the rear of the card, the flower stem or stems passing through an aperture in the card. A region is provided on the face of the card which is receptive to ink so that a message or signature may be written on the card, while the card as a whole is resistant to moisture.

13 Claims, 3 Drawing Figures

COMMEMORATIVE CARD

BACKGROUND OF THE INVENTION

This invention relates to commemorative cards, e.g., for birthdays, anniversaries or as condolences in the case of bereavements.

The card is preferably formed from a water impervious sheet plastics material although it can be formed from other suitable materials such as waxed or plastics coated paper or card.

The card of the present invention may be printed with any suitable pattern, design or ornament and with any suitable wording such as a birthday or anniversary greeting or a message of sympathy. At least one area or region of the card may be adapted to receive ink so that a personal message or signature can be handwritten thereon. Thus, for example, at least one area or region of the card may be chemically etched or treated to render it receptive to ink or a paper label may be adhered or otherwise secured over said area or region for the reception of a handwritten message or signature.

The card may be recessed or otherwise formed, e.g. as by vacuum forming or the like, to receive a flower or flowers.

The means for mounting at least one flower on the card may be of any suitable kind and may comprise, for example, one or more clips or ties. A particularly suitable form of mounting means comprises slitting the card to provide a pair of spaced oppositely directed lugs over which a small elastic band can be engaged to retain a flower.

The card of the present invention may be used with either artificial or fresh flowers. For use with fresh flowers means is provided for supplying moisture to the flower or flowers. Such moisture providing means may comprise, for example, a hard foamed plastics material such as that sold under the Registered Trademark "Oasis" which will retain water and into which the stem of a flower or flowers can be inserted. The hard foamed plastics material may be contained in a pocket or recess formed in or on card, e.g., on the rear surface of the card so that the hard foamed plastics material will be concealed from view. Alternatively, the moisture providing means could comprise a small tube or phial of plastics or other suitable material adapted to contain water or cotton wool or other suitable material soaked in water, the tube or phial being provided with suitable sealing means to provide a seal around the stem of a flower or flowers if desired or necessary.

If desired, a transparent or transluscent cover, e.g. of plastics material, may be provided which will cooperate with the card to enclose a flower mounted on the card and such cover may serve both to protect the flower and to preserve moisture to delay drying out of a flower or flowers.

Where a card according to the present invention is intended as a condolence in the case of a bereavement then the card may comprise at least one spike, pin or the like which can be inserted into the ground, e.g. in a Garden of Remembrance.

SUMMARY OF THE INVENTION

The invention has as its object to provide a commemorative card which is more distinctive and more suited to special occasions than conventional greetings cards and which, if used as a condolence in the case of a bereavement, can be left in the open, e.g. on a grave or in a Garden of Rememberance, without suffering damage.

It is a further object of the present invention to provide a commemorative card formed from water resistant material having means for mounting at least one flower thereon and means for supplying moisture to at least one flower.

A still further object of the present invention is to provide a card having at least one aperture therein through which the stem of at least one flower can be inserted so that the end of the stem lies at the rear of the card.

These and other objects of the present invention are attained by means of a commemorative card formed from a water resistant material for mounting a flower therein and a moisture retaining material arranged to provide moisture to the flower. In one form of the invention a strip of similar card material is secured to the card which defines an open sleeve in which a waterproof bag is retained. The bag has an opening into which at least one flower is inserted and the flower is then attached to the card to prevent it from falling out of the bag.

BRIEF DESCRIPTION OF THE DRAWINGS

The present invention will be more partically described with reference to the accompanying diagrammatic drawings, in which:

Referring to FIGS. 1 and 2 of the drawings it will be seen that the card 1 has flowers 2 mounted thereon as by means of bands or ties 3.

DESCRIPTION OF THE INVENTION

Figure 1:
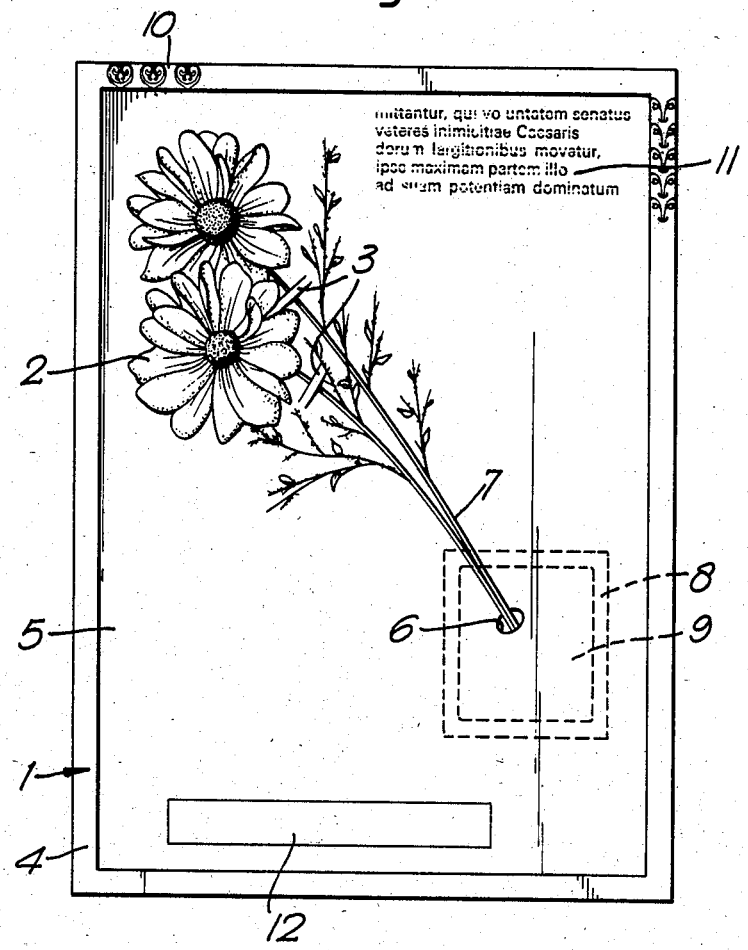
FIG. 1 is a front elevation of a card according to the present invention.
Figure 2:
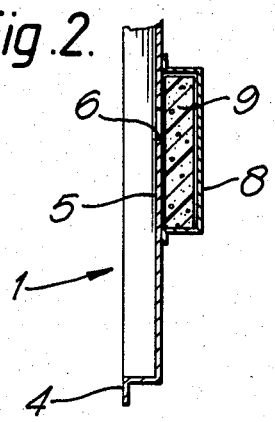
FIG. 2 is a fragmentary side elevation showing a detail thereof.

The card 1 is formed from sheet plastics material which has been formed to provide a raised border 4 and a recessed central portion 5. The card 1 has an aperture 6 therein through which the stems 7 of the flowers 2 extend. Clips or ties 3 spaced from the aperture 6 are fastened to the stems 7 of the flowers 2 and hold the flowers 2 to the front of the card 1. Mounted on the rear surface of the card around the aperture 6 is a pocket forming member 8 of plastics or other waterproof material in which is mounted a block 9 of hard foamed plastics material capable of containing water and into which the stems 7 of the flowers 2 can be inserted.

Because the card 1 and the pocket forming member 8 are formed from water impervious material water can be inserted through the aperture 6 to thoroughly soak the block 9 of hard foamed plastics material and, in addition, the card 1 and flowers 2 can be sprayed with water to preserve the freshness of the flowers 2.

The card 1 may be printed and/or embossed or otherwise provided with any suitable pattern or ornamentation such as is partially indicated at 10 and/or may be printed with any suitable wording such as a verse or greeting as diagrammatically indicated at 11. To enable the card to be personalized a strip 12 is provided which is receptive to ink and which enables the card to be signed or a handwritten message to be provided thereon. The strip 12 may be provided by suitable chemical or mechanical treatment of the surface of the card 1 or by adhering or otherwise securing a strip of paper or other suitable material thereon.

If desired the card may comprise means which will enable it to stand such as by providing it with a second leaf or by providing a hinged leg or support on the rear surface thereof. If desired the card may comprise means which will enable it to stand such as by providing it with a second leaf or by providing a hinged leg or support on the rear surface thereof. If desired the card may be mounted in a box or may be provided with a transparent or a transluscent cover, e.g. of plastics material, which will enclose the flowers 2 and so held to maintain their freshness.

Figure 3:
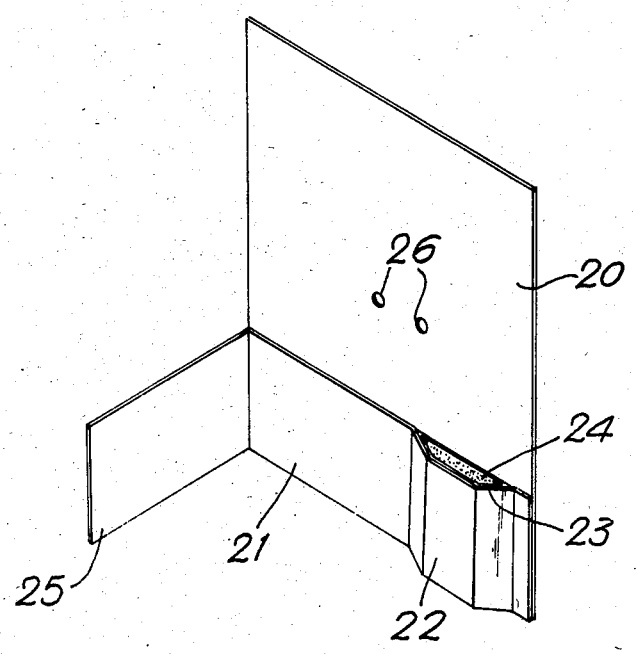
FIG. 3 is a perspective view of another embodiment of a card according to the invention.

Referring now to FIG. 3 it will be seen that the card 20, which is formed from a water resistant plastics coated cardboard or the like, has a separated strip 21 of similar material adhesively or otherwise secured thereto along a lower portion thereof. The strip 21 is formed to provide with the card 20 an open-ended sleeve 22. The sleeve 22 contains an open topped waterproof bag 23, e.g., of polythene or other suitable plastics material, which in turn contains a moisture retaining material 24, such as a block of hard foamed plastics material, into which the stems of flowers can be inserted.

The strip 21 is extended beyond one side edge of the card 20 to provide a second leaf 25 which can be opened as shown to enable the card to be free-standing.

Apertures 26 are provided in the card 20 through which a suitable tie or ties, such as a ribbon, can be inserted and tied, e.g., in a decorative bow, to retain flowers whose stems have been inserted in the material 24.

As in the previous embodiment, the card 20, strip 21 and/or leaf 25 may be provided with any desired pattern or ornamentation and may be printed with any suitable wording or the like, such as a verse or greeting.

I claim:

1. In a commemorative card assembly comprising a flat card member having at least one receptacle means to receive the stem of a fresh flower, water retaining means including a mass of water-retentive material disposed on the card member at the location of said receptacle means and into which the stem of the fresh flower is to be received, and said receptacle means including means on said card member for mounting the flower on the front of the card member; the improvement wherein said card member is formed of a water-impervious material so that the commemorative card assembly can be left in the open without suffering damage, and so that water stored in the water-retentive material will not damage the card member.

2. A commemorative card assembly according to claim 1, wherein said water-retentive material comprises a water-retentive hard foamed plastics material.

3. A commemorative card assembly according to claim 1, wherein said card member includes an open-ended sleeve formed on the reverse of said card member with said water-retentive material being contained in said sleeve.

4. A commemorative card assembly according to claim 3, wherein said water retaining means includes a waterproof bag in said sleeve and containing said mass of water-retentive material.

5. A commemorative card assembly according to claim 1, wherein said receptacle means includes a perforation in the card member and a pocket mounted on said card member at the location of said perforation and containing said water retaining means.

6. A commemorative card assembly according to claim 5, wherein said water retaining means includes a waterproof bag containing said mass of water-retentive material.

7. A commemorative card assembly according to claim 1, wherein a portion of the water-impervious material of the flat card member is treated to be receptive to ink so that the card member might be provided with a signature or handwritten message.

8. A commemorative card assembly according to claim 1, wherein said card assembly further comprises means enabling the card assembly to stand.

9. A commemorative card assembly according to claim 8, wherein said means enabling the card assembly to stand includes a strip formed of a water-impervious material having a leaf secured along a portion of the card member and another leaf hingedly connected to the first-mentioned leaf and which can be opened out to enable the card assembly to be free standing.

10. A commemorative card assembly according to claim 9, wherein a portion of the first-mentioned leaf of said strip defines a pocket serving as said receptacle means and within which said water retaining means is contained.

11. A commemorative card assembly according to claim 1, wherien said means for mounting the flower on the front of the card member includes one or more securing members spaced from the receptacle means for securing the stem of the flower to the front of the card member.

12. A commemorative card assembly according to claim 1, wherein said water-impervious material includes sheet plastics material.

13. A commemorative card assembly according to claim 1, wherein said water-impervious material includes plastics-coated paper or card.

* * * * *